US008267020B2

(12) United States Patent
Mann

(10) Patent No.: US 8,267,020 B2
(45) Date of Patent: Sep. 18, 2012

(54) COAL NOZZLE TIP SHROUD

(75) Inventor: Jeffrey S. Mann, Hingham, MA (US)

(73) Assignee: Alstom Technology Ltd (CH)

( * ) Notice: Subject to any disclaimer, the term of this patent is extended or adjusted under 35 U.S.C. 154(b) by 382 days.

(21) Appl. No.: 11/758,253

(22) Filed: Jun. 5, 2007

(65) Prior Publication Data

US 2008/0304956 A1 Dec. 11, 2008

(51) Int. Cl.
*F23D 1/00* (2006.01)
*F23K 3/02* (2006.01)

(52) U.S. Cl. ..... 110/104 B; 110/261

(58) Field of Classification Search ..... 110/260, 110/261, 263, 265, 104 R, 104 B; 239/419.5, 239/424.5, 553.5, 590.5; 29/439
See application file for complete search history.

(56) References Cited

U.S. PATENT DOCUMENTS

| | | | | |
|---|---|---|---|---|
| 2,029,337 | A * | 2/1936 | Parker | 239/417.3 |
| 2,895,435 | A | 7/1954 | Bogot et al. | |
| 3,823,875 | A * | 7/1974 | Bauer et al. | 239/419.5 |
| 4,356,975 | A * | 11/1982 | Chadshay | 239/419.5 |
| 6,018,859 | A * | 2/2000 | Borzym et al. | 29/458 |
| 6,089,171 | A * | 7/2000 | Fong et al. | 110/263 |
| 6,105,516 | A * | 8/2000 | Bowen | 110/261 |
| 6,189,812 | B1 * | 2/2001 | Buridant | 239/423 |
| 6,260,491 | B1 * | 7/2001 | Grusha | 110/261 |
| 6,439,136 | B1 * | 8/2002 | Mann et al. | 110/263 |
| 2003/0201345 | A1 * | 10/2003 | Jeong | 239/542 |

FOREIGN PATENT DOCUMENTS

| | | |
|---|---|---|
| CA | 2365932 | 7/2003 |

OTHER PUBLICATIONS

PCT International Search Report and The Written Opinion of the International Searching Authority dated Feb. 23, 2009—(PCT/US2008/061854).
Corresponding Canadian Appln. No. 2,687,612—Examination Report—dated May 24, 2011.

* cited by examiner

*Primary Examiner* — Kenneth Rinehart
*Assistant Examiner* — David J Laux
(74) *Attorney, Agent, or Firm* — Cantor Colburn LLP

(57) ABSTRACT

An outer shroud for a solid fuel nozzle tip includes: an top shell portion and a bottom shell portion, each portion fabricated from a preform produced from a single sheet of flat stock and each shell portion including a forward area and a backward area and outlet sidewalls, wherein a right outlet sidewall and a left outlet sidewall are each separated from the forward area by a rounded corner; and a left inlet sidewall and a right inlet sidewall coupled to the top shell portion and the bottom shell portion.

13 Claims, 7 Drawing Sheets

COAL NOZZLE TIP SHROUD

BACKGROUND OF THE INVENTION

1. Field of the Invention

The present invention relates to pulverized solid fuel delivery systems and, more particularly, to a nozzle assembly for use in a pulverized solid fuel delivery system.

2. Description of the Related Art

Systems for delivering pulverized solid fuel (e.g. coal) to steam generators typically include a plurality of nozzle assemblies through which pulverized coal is delivered into a combustion chamber of the steam generator. The nozzle assemblies are typically disposed within windboxes, which may be located proximate the corners of the steam generator. Each nozzle assembly includes a nozzle tip, which protrudes into the combustion chamber. Typically, the nozzle tips are arranged to tilt up and down to adjust the location of the flame within the combustion chamber.

One prior art nozzle tip is depicted in FIG. 1, and more completely described in U.S. Pat. No. 6,089,171, entitled "Minimum Recirculation Flame Control (MRFC) Pulverized Solid Fuel Nozzle Tip," issued Jul. 18, 2000 to Fong et. al, the disclosure of which is incorporated by reference herein, where such disclosure provides a basis for the teachings disclosed herein.

hi FIG. 1, a first embodiment of the MRFC solid fuel nozzle tip 36 includes a secondary air shroud 39; a primary air shroud 40; a secondary air shroud support 50; and splitter plate 51. To facilitate the acquiring of an understanding of the nature of the construction and the mode of operation of the first embodiment of the MRFC solid fuel nozzle tip 36, dotted lines provide a representation of a portion of a fuel compartment 12 and a longitudinally extending portion 38 of the pulverized solid fuel nozzle tip 36. Note the direction of flow of the primary air and pulverized solid fuel is generally depicted by reference numeral 44.

In this embodiment, the secondary air shroud 39 embodies at the inlet end thereof a bulbous configuration 106. The bulbous configuration 106 minimizes bypass of secondary air around the secondary air shroud 39, (i.e., air will not flow through the secondary air shroud 39, particularly under tilt conditions, such as when the secondary air shroud 39 is an upwardly tilt position or a downwardly tilt position relative to the centerline of the MRFC solid fuel nozzle tip 36). Should secondary air bypass the secondary air shroud 39 this also has the concomitant effect of adversely impacting the extend to which the secondary air is capable of carrying out the cooling effect on the secondary air shroud 39 desired therefrom. In addition to the bulbous configuration 106 thereof, the secondary air shroud 39 is further characterized by the embodiment therein of rounded corners, denoted in FIG. 2.

Referring to the embodiment of FIG. 2, a rearward perspective view of the nozzle tip 36 is provided. In the embodiment of FIG. 2, the secondary air shroud 39 includes rounded corners 8. Each of the rounded corners 8 are generally triangular in shape. Assembly of the secondary air shroud 39 calls for separately welding each of the rounded corners 8 into place.

In the embodiments provided in U.S. Pat. No. 6,089,171, the rounded corners 8 of the secondary air shroud 39 are made to embody the same predetermined radius. The rounded corners 8 of the secondary air shroud 39 operate to provide higher velocities in the corners of the secondary air shroud 39, which in turn effectively minimize the existence of low velocity regions on the secondary air shroud 39 that might otherwise lead to unwanted solid fuel deposition.

Although the nozzle tip 36 of the '171 patent has a number of advantages, one skilled in the art will readily surmise, having welded rounded corners 8 may compromise both strength of the secondary air shroud 39 as well as economic construction of the secondary air shroud 39.

Therefore, what are needed are improved techniques for assembly of a secondary air shroud of a nozzle tip, such as the one disclosed in the '171 patent. Preferably, the techniques provide for improved cost of manufacture as well as improved strength.

BRIEF SUMMARY OF THE INVENTION

Disclosed is an outer shroud for a solid fuel nozzle tip, the outer shroud including: an top shell portion and a bottom shell portion, each portion fabricated from a preform produced from a single sheet of flat stock and each shell portion including a forward area and a backward area and outlet sidewalls, wherein a right outlet sidewall and a left outlet sidewall are each separated from the forward area by a rounded corner; and a left inlet sidewall and a right inlet sidewall coupled to the top shell portion and the bottom shell portion.

Also disclosed is a method for fabricating an outer shroud for a solid fuel nozzle tip, the method including: selecting a preform cut from flat stock for each of a top shell portion and a bottom shell portion; shaping each preform to form the top shell portion and the bottom shell portion; bending each preform to form outlet sidewalls and rounded corners for each shell portion; and coupling the top shell portion and the bottom shell portion.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION OF THE INVENTION

Disclosed is a coal nozzle tip outer shroud that includes increased corner strength and reduced manufacturing costs when compared to prior art designs. As discussed herein, the shroud may be used as a replacement for the secondary air shroud 39 of the prior art discussed above, as well as a replacement for other similar shrouds in other prior art designs.

Figure 1:
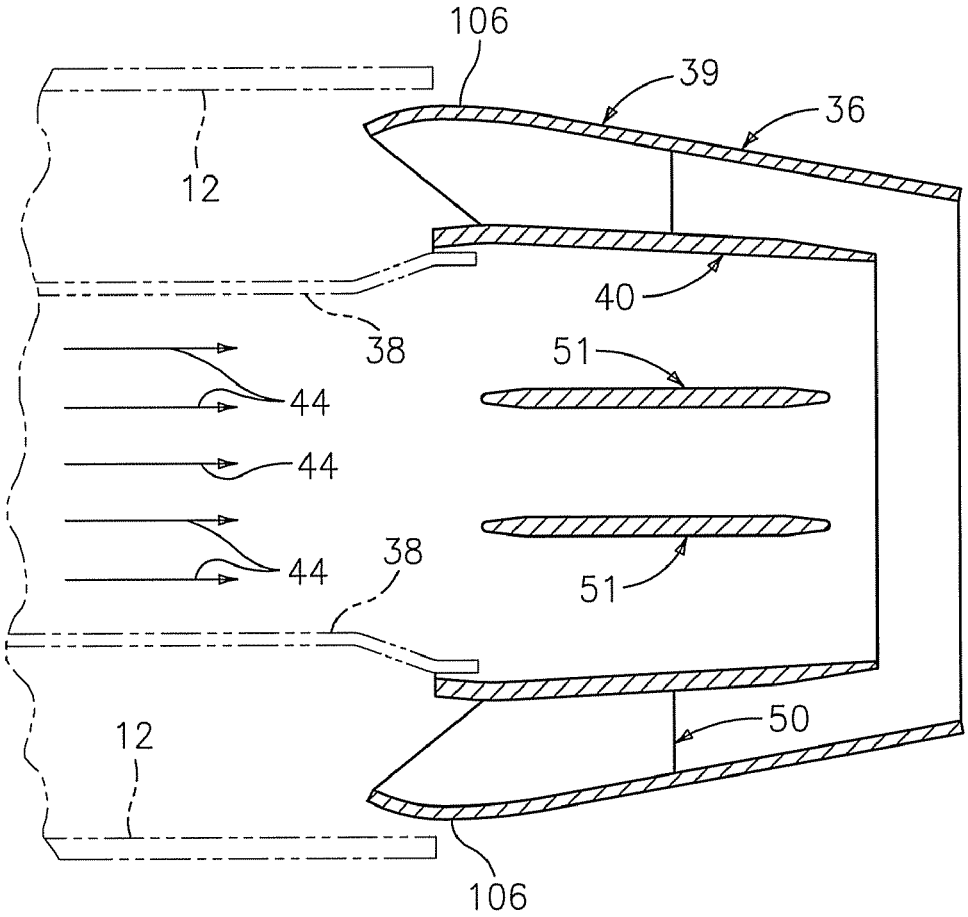
FIG. 1 (PRIOR ART)
FIG. 1 is a schematic representation of a prior art nozzle tip.
Figure 2:
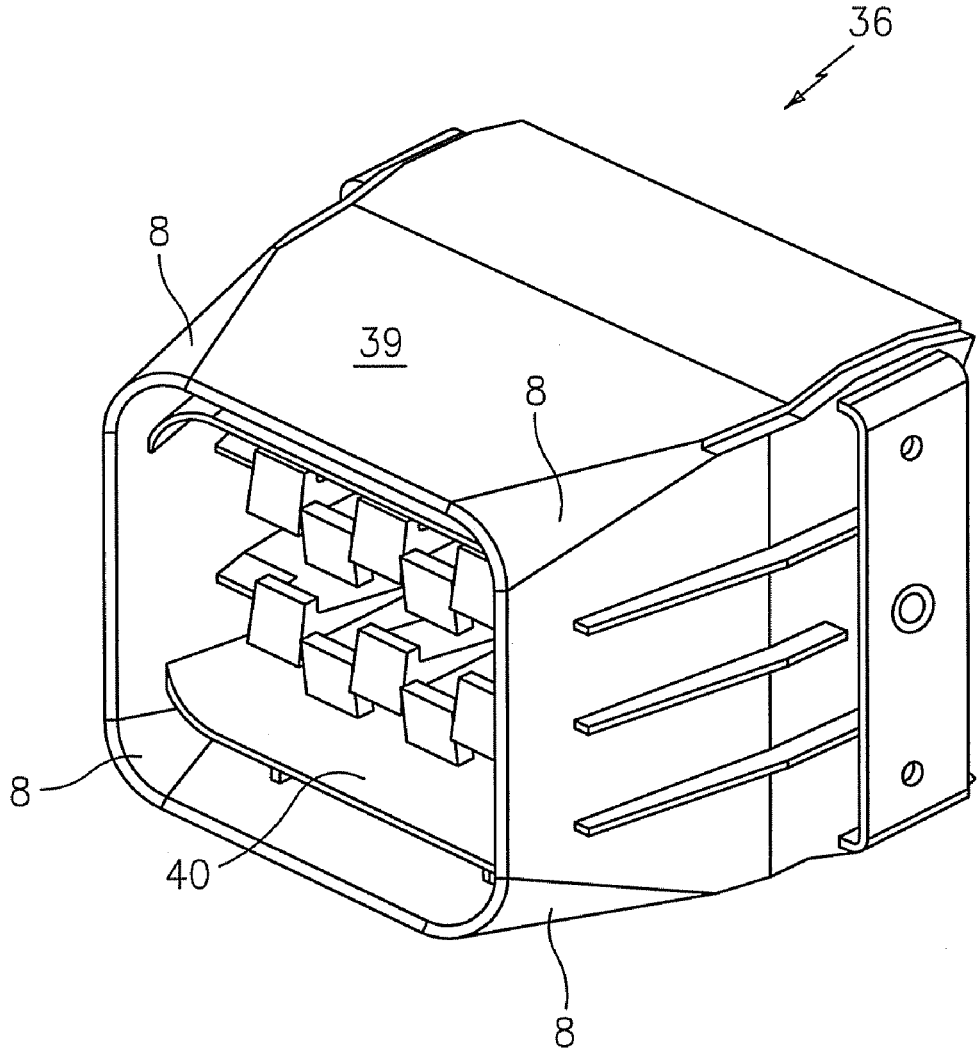
FIG. 2 (PRIOR ART)
FIG. 2 is a rear perspective view of the nozzle tip of FIG. 1 showing rounded corners.
Figure 3:
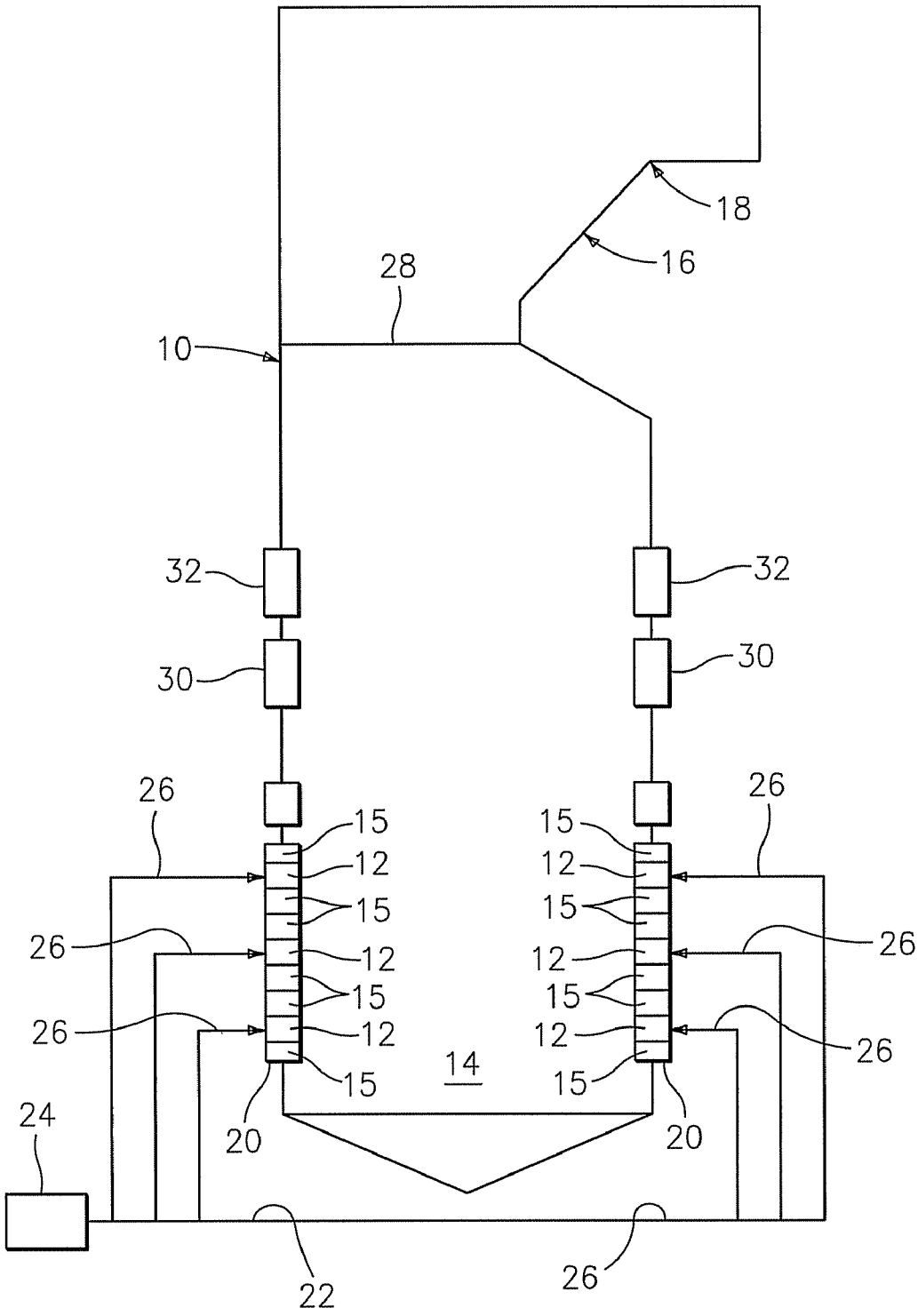
FIG. 3 is a schematic depiction of a solid fuel-fired steam generator including a plurality of windboxes having fuel compartments disposed therein.

Referring now to FIG. 3, a pulverized solid fuel-fired steam generator 10 is shown to include a combustion chamber 14 within which the combustion of pulverized solid fuel (e.g., coal) and air is initiated. Hot gases that are produced from combustion of the pulverized solid fuel and air rise upwardly in the steam generator 10 and give up heat to fluid passing through tubes (not shown) that in conventional fashion line the walls of the steam generator 10. The hot gases exit the steam generator 10 through a horizontal pass 16 of the steam generator 10, which in turn leads to a rear gas pass 18 of the steam generator 10. Both the horizontal pass 16 and the rear gas pass 18 may contain other heat exchanger surfaces (not shown) for generating and superheating steam, in a manner well-known to those skilled in this art. The steam generated in the steam generator 10 may be made to flow to a turbine (not shown), such as used in a turbine/generator set (not shown), or for any other purpose.

The steam generator 10 includes one or more windboxes 20, which may be positioned in the corners of the steam generator 10. Each windbox 20 is provided with a plurality of air compartments 15 through which air supplied from a suitable source (e.g., a fan) is injected into the combustion chamber 14 of the steam generator 10. Also disposed in each windbox 20 is a plurality of fuel compartments 12, through which pulverized solid fuel is injected into the combustion chamber 14 of the steam generator 10.

The solid fuel is supplied to the fuel compartments 12 by a pulverized solid fuel supply 22, which includes a pulverizer 24 in fluid communication with the fuel compartments 12 via a plurality of pulverized solid fuel ducts 26. The pulverizer 24 is operatively connected to an air source (e.g., a fan), whereby the air stream generated by the air source transports the pulverized solid fuel from the pulverizer 24, through the pulverized solid fuel ducts 26, through the fuel compartments 12, and into the combustion chamber 14 in a manner which is well known to those skilled in the art.

The steam generator 10 may be provided with two or more discrete levels of separated overfire air incorporated in each corner of the steam generator 10 so as to be located between the top of each windbox 20 and a furnace outlet plane 28 of the steam generator 10, thereby providing a low level of separated overfire air 30 and a high level of separated overfire air 32.

Figure 4:
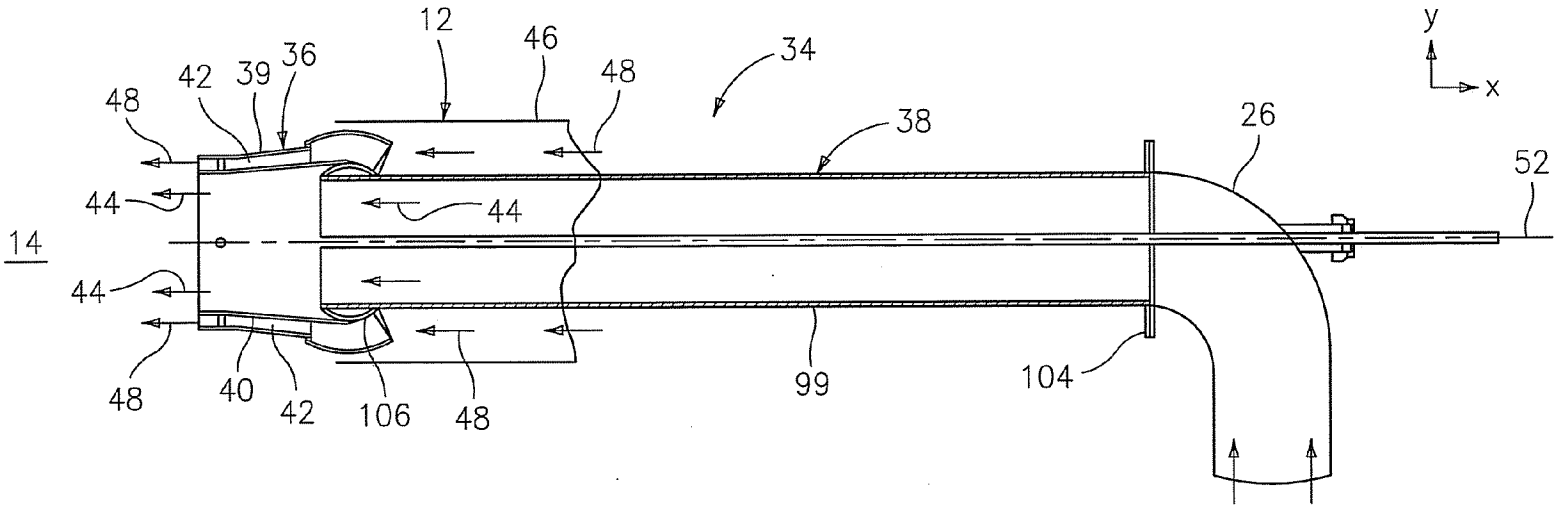
FIG. 4 depicts an embodiment of a nozzle assembly for the combustion system of FIG. 3.
Figure 5:
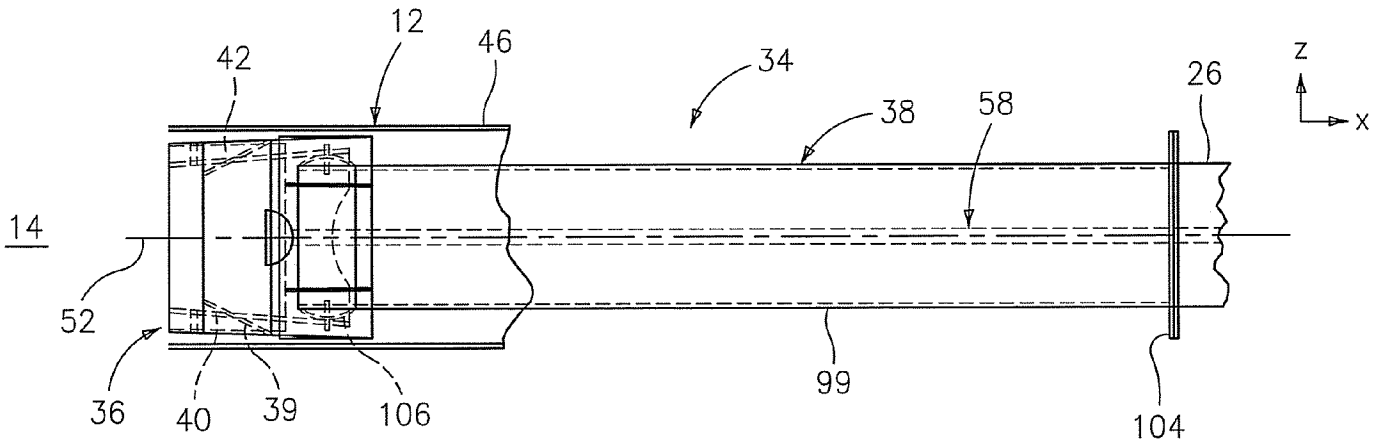
FIG. 5 depicts further aspects of the nozzle assembly of FIG. 4.

FIG. 4 depicts a non-limiting embodiment of a cross-sectional, elevation view of a pulverized solid fuel nozzle assembly 34 disposed within a fuel compartment 12 as taken along a x-y plane, and FIG. 5 depicts a cross-sectional, plan view of the pulverized solid fuel nozzle assembly 34 disposed within the fuel compartment 12 as taken along a x-z plane, which is perpendicular to the x-y plane. While only one fuel compartment 12 is shown, it will be appreciated that each fuel compartment 12 of FIG. 3 may include a nozzle assembly 34.

Referring to FIGS. 4 and 5, the nozzle assembly 34 includes a nozzle tip 36, which protrudes into the combustion chamber 14, and a fuel feed pipe 38, which extends through the fuel compartment 12 and is coupled to a pulverized solid fuel duct 26. The fuel feed pipe 38 comprises a generally rectangular shell 99 having a flange 104 disposed at one end for securing the fuel feed pipe 38 to the solid fuel duct 26 (FIG. 4), and a bulbous protrusion 106 disposed at the other end for providing a seal between the fuel feed pipe 38 and nozzle tip 36, as will be described in further detail hereinafter. By "generally rectangular" it is meant that the inner surface of the shell provides a flow path having a rectangular cross-section throughout much of the length of the shell. It is also contemplated that the cross section of the shell 99 may be of a different shape, such as of a circular shape.

The nozzle tip 36 has a double shell configuration, comprising an outer shell 39 and an inner shell 40. The inner shell 40 is coaxially disposed within the outer shell 39 to provide an annular space 42 between the inner and outer shells 40, 39. The inner shell 40 is connected to the fuel feed pipe 38 for feeding a stream 44 of pulverized solid fuel entrained in air through the fuel feed pipe 38 and the inner shell 40 into the combustion chamber 14. The annular space 42 is connected to a secondary air conduit 46 for feeding a stream of secondary air through the secondary air conduit 46, into the annular space 42, and into the combustion chamber 14. The secondary air is used in combustion and helps to cool the nozzle tip 36.

The nozzle assembly 34 is suitably supported within the fuel compartment 12, and any conventional mounting technique may be employed. The secondary air conduit 46 may be coaxially aligned with a longitudinal axis 52 of the generally cylindrical shell 99, such that the fuel feed pipe 38 is centered within the secondary air conduit 46.

It is contemplated that the nozzle assembly 34 may be dimensioned such that the nozzle assembly 34 can be used in place of an existing, prior art nozzle assembly. It will be appreciated that the nozzle assembly 34 can thus be retrofitted into an existing steam generator with minimal modification to existing windbox controls or operation. It is also contemplated that the nozzle assembly 34 can be used in new installations.

Figure 6:
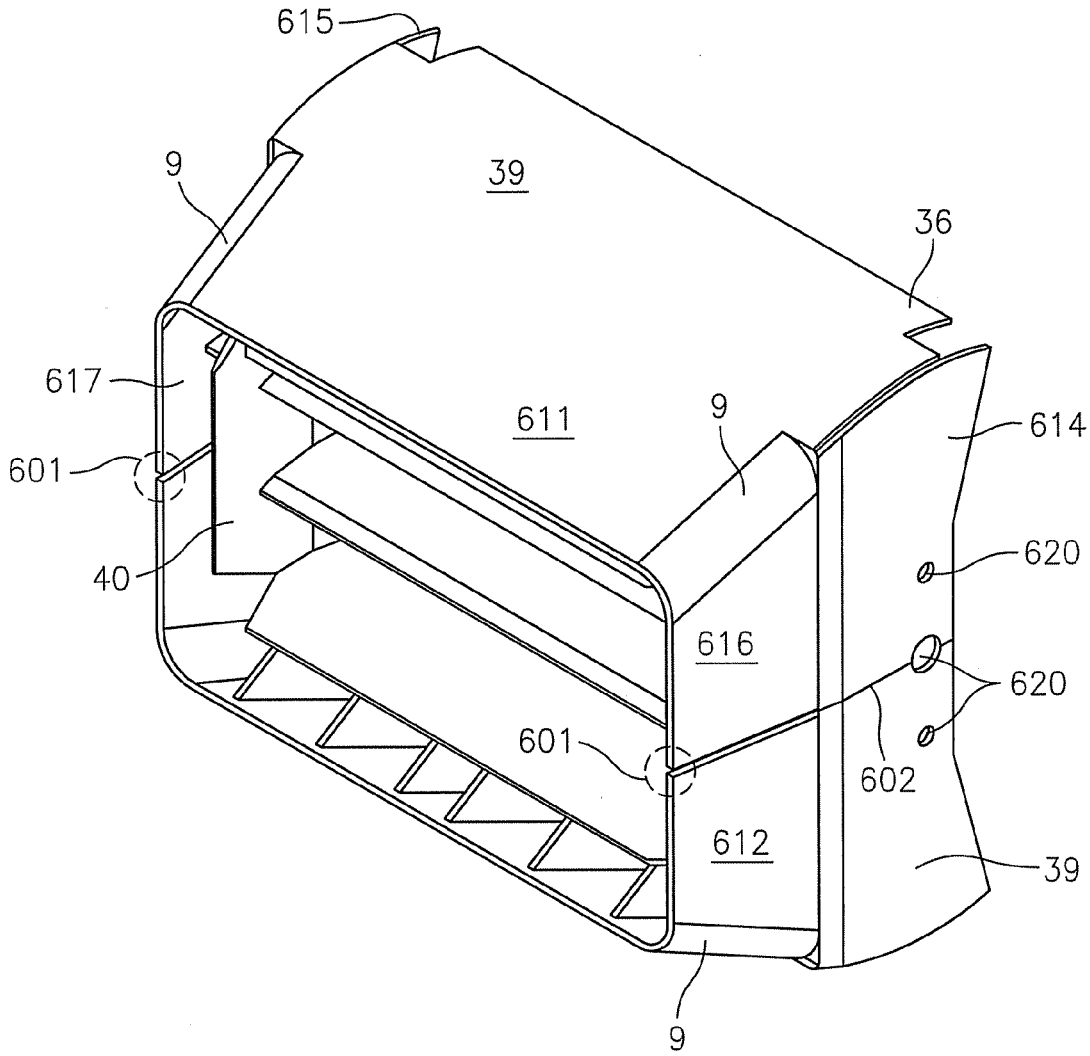
FIG. 6 depicts a rear perspective view of a nozzle tip according to the teachings herein.

Referring now to FIG. 6, there are shown aspects of a nozzle tip 36 according to an embodiment of the present invention. In FIG. 6, the nozzle tip 36 includes an outer shell 39. In some embodiments, the outer shell 39 is fabricated from a top shell portion 611 and a bottom shell portion 612. The top shell portion 611 and the bottom shell portion 612 may be symmetric with respect to each other, as shown herein. The top shell portion 611 and the bottom shell portion 612 include corner sections 9 that are generally rounded and provide for a higher flow velocities in the corners, thus avoiding unwanted solid fuel deposition. Each of the top shell portion 611 and the bottom shell portion 612 include a outlet sidewall portion. For simplicity, attention of the reader is directed to only the outlet sidewall portions of the top shell portion 611. As can be seen in FIG. 6, the top shell portion 611 includes a right outlet sidewall portion 616 and a left outlet sidewall portion 617.

The top shell portion 611 and the bottom shell portion 612 are cut from a single piece of flat metal stock, which results in a flat preform (as shown in FIG. 9). Each portion 611, 612 is then folded and bent appropriately to provide for the desired shape. Once each of the top shell portion 611 and the lower shell portion 612 have been shaped, the portions are coupled to provide the outer shell 39.

Figure 7:
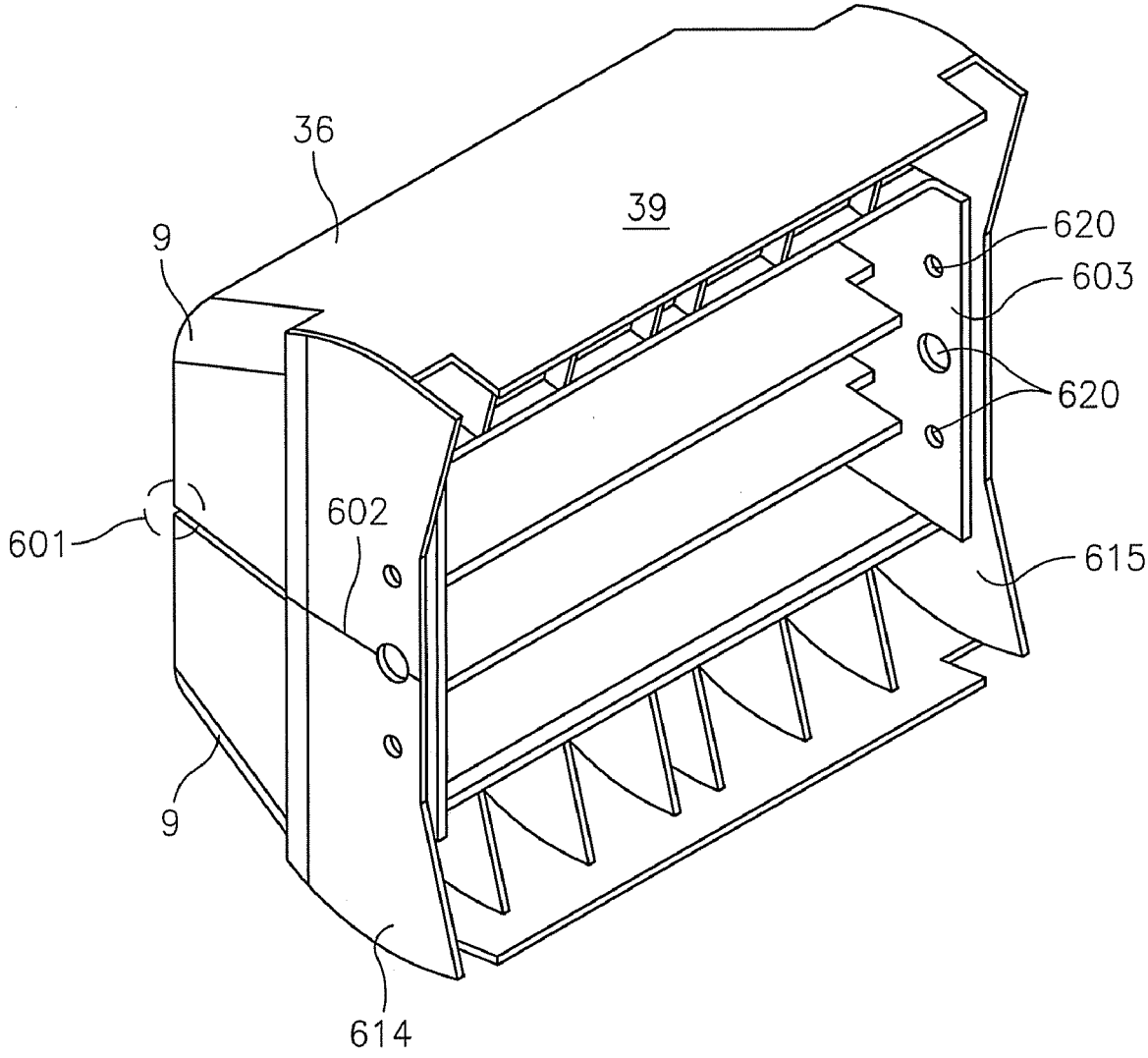
FIG. 7 depicts a front perspective view of a nozzle tip according to the teachings herein.

Further, and with reference to FIG. 7 as well, in some embodiments, the top shell portion 611 and the bottom shell portion 612 are connected by a weld formed at least partially along a seam 601 between the top shell portion 611 and the bottom shell portion 612 (in other embodiments, additional hardware is used). The weld ensures that sidewalls of the outer shell 39 remain in a rigid and generally continuous form. Also shown in FIGS. 6 and 7 are inlet sidewalls. A left inlet sidewall 614 and a right inlet sidewall 615 are fabricated separately from the top shell portion 611 and the bottom shell portion 612. The left inlet sidewall 614 and a right inlet sidewall 615 may also be coupled to the top shell portion 611 and the bottom shell portion 612 by welding the pieces together. In some embodiments, each of the inlet sidewalls 614, 615 include a plurality of annulus 620. The plurality of annulus 620 are useful for incorporation of a joiner plate 603, such as by at least one a weld and additional hardware. The joiner plate 603 may further be used for mounting of the nozzle tip 36. In various embodiments, the joiner plate 603 is adapted for coupling with outlet sidewalls of the top or bottom shell portions 611, 612. In the embodiment depicted, the joiner plate 603 also forms sidewalls of the inner shell 40.

Figure 9A:
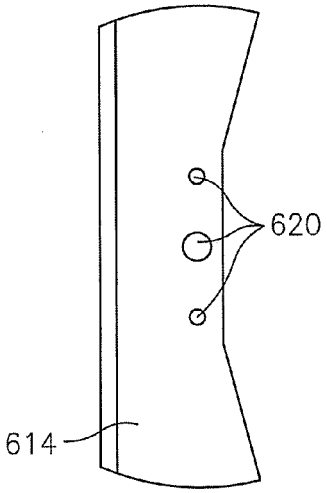
FIG. 9A and FIG. 9B, collectively referred to as FIG. 9, depict embodiments of a sidewall of the nozzle tip of FIGS. 6 and 7.
Figure 9B:
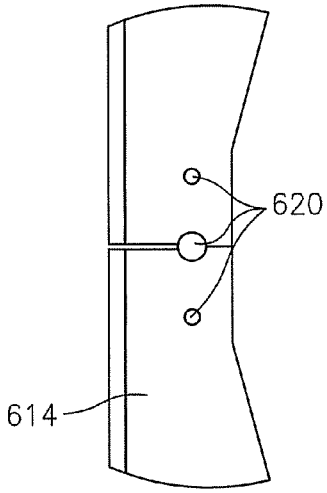

In some embodiments, at least one of the inlet sidewalls 614, 615 is fabricated from separate pieces. Reference may be made to FIG. 9B, which shows the left inlet sidewall 614 as having an upper piece and a lower piece. Another embodiment of the left inlet sidewall 614 is depicted in FIG. 9A, wherein the left inlet sidewall 614 is formed from a single piece of stock.

In some embodiments, the top shell portion 611 and the bottom shell portion 612 are assembled together by the incorporation of the left inlet sidewall 614 and the right inlet sidewall 615. This may include bolting or welding of the joiner plate 603 to each of the respective inlet sidewalls 614, 615 as well as welding along top and bottom edges of each sidewall to the respective portions 611, 612.

Figure 8:
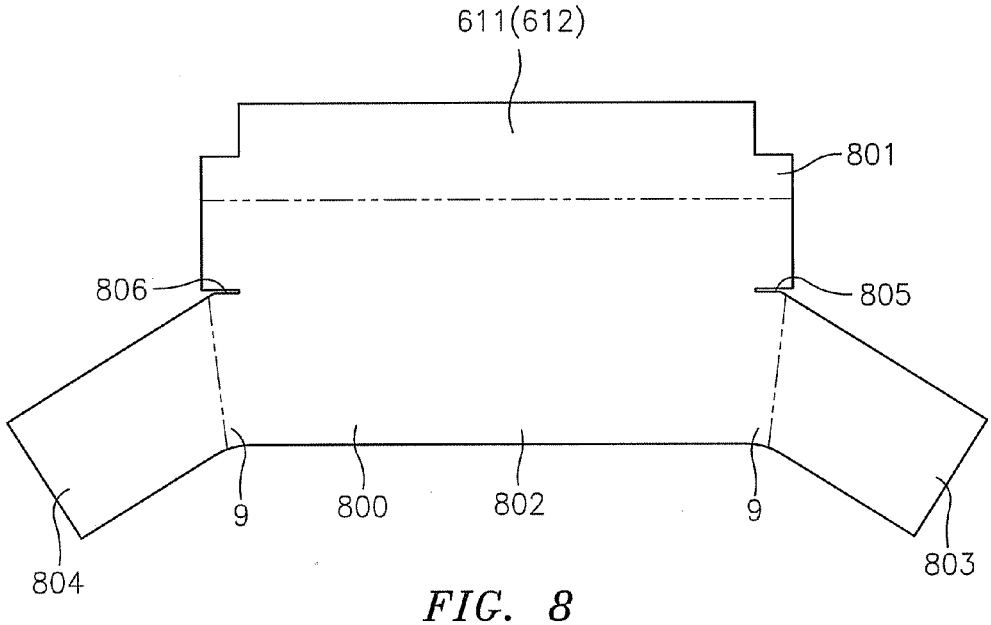
FIG. 8 depicts a template for forming one of an upper shell portion and a lower shell portion.

Referring now to FIG. 8, an exemplary preform 800 is shown. The preform 800 is folded, bent or formed to provide for one of the top shell portion 611 and the bottom shell portion 612. In the embodiment shown in FIG. 8, the preform 800 includes a forward area 802, a backward area 801, a left flap 804 and a right flap 803. The forward area 802 may include a respective left slit 806 and a right slit 805 to provide for shaping of the rounded corner sections 9. In frequent embodiments, the preform 800 is formed about fold lines (shown in FIG. 8 with dashed lines). As may be recognized from FIG. 7 and with a perspective from the backward area 801 generally slopes upwardly (about to the location of the fold line, not shown in FIG. 7), while the forward area 802 generally slopes downwardly from the fold line or area.

For convenience of reference, a correlation between aspects of the preform 800 (of FIG. 8) and the top shell portion 611 (of FIG. 6) is provided. As shown in FIG. 8, the left flap 804 correlates to the left outlet sidewall portion 617, while the right flap 803 correlates to the right outlet sidewall portion 616. The forward area 802 correlates to the top surface of the top shell portion 611. The fold lines appearing between the right and left flaps 803, 804 and the forward area 802 (as depicted in FIG. 8) provide for shaping of the rounded corner sections 9.

One skilled in the art will recognize that the term "fold line" may be more properly considered as a point about which folding or shaping occurs. That is, gradual shaping, such as depicted in FIGS. 6 and 7 are within the teachings herein. Accordingly, the terminology of "fold line" is generally provided as an indication of shaping points and is not limiting of the teachings herein.

The outer shell 39 fabricated according to the teachings herein may be used in conjunction with aspects of the prior art, such as the support means 50. Further, one skilled in the art will recognize that other adaptations and embodiments may be had. For example, portions of the front sidewalls may be incorporated into the template 800 instead of using separate components.

Accordingly, the outer shell 39 may be fabricated from flat stock with little shaping involved. Problems of the prior art assembly techniques, for example, alignment of the triangular portions are thus avoided. Results include a stronger outer shroud (i.e., shell) than previously achieved, with an additional benefit of reduced fabrication costs.

One skilled in the art will recognize that terminology such as "outer shell" and "outer shroud" are generally interchangeable. As used herein, such terms generally make reference to one design or another for the nozzle tip. However, as these and other features of the nozzle tip may be interchangeable, such terms are non-limiting of the teachings herein.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An outer shroud for a solid fuel nozzle tip comprising:

a) top shell portion having:

a substantially horizontal backward area;

a forward area connected to the backward area that angles downward as it extends away from the backward area, the forward area having a left and right side, a right outlet sidewall extending downward from the right side of the forward area, a left outlet sidewall extending downward from the right side of the forward area, a rounded corner connecting the right side of the forward area with the right outlet sidewall;

a rounded corner connecting the left side of the forward area with the left outlet sidewall;

wherein the backward area, the forward area, right outlet sidewall, the left outlet sidewall and the rounded corners are all formed by bending a single piece of flat stock; wherein the flat stock has a thickness of up to 0.95 cm (⅜ in);

b) a bottom shell portion having:

a substantially horizontal backward area;

a forward area connected to the backward area that angles upward as it extends away from the backward area, the forward area having a left and right side, a right outlet sidewall extending upward from the right side of the forward area, a left outlet sidewall extending upward from the right side of the forward area, a rounded corner connecting the right side of the forward area with the right outlet sidewall;

a rounded corner connecting the left side of the forward area with the left outlet sidewall;

wherein the backward area, the forward area, right outlet sidewall, the left outlet sidewall and the rounded corners are all formed by bending a single piece of flat stock; wherein the flat stock has a thickness of up to 0.95 cm (⅜ in); and c) a left inlet sidewall and a right inlet sidewall fabricated separately from the top shell portion and the bottom shell portion, and extending between the backward areas of the top and bottom shell portions; wherein the flat stock has a thickness of up to 0.95 cm (⅜ inch).

2. The outer shroud for a solid fuel nozzle tip of claim 1, wherein the top shell portion and the bottom shell portion are coupled together by at least one weld point.

3. The outer shroud for a solid fuel nozzle tip of claim 1, wherein the top shell portion and the bottom shell portion are coupled together by more than one weld point.

4. The outer shroud for a solid fuel nozzle tip of claim 1, wherein the top shell portion and the bottom shell portion are coupled together by at least one weld point along one of the left outlet sidewall and the right outlet sidewall.

5. The outer shroud for a solid fuel nozzle tip of claim 1, wherein at least one of the left inlet sidewall and the right inlet sidewall comprises a plurality of annular-shaped openings.

6. The outer shroud for a solid fuel nozzle tip of claim 1, further comprising at least one joiner plate coupled to at least one of the left inlet sidewall and the right inlet sidewall.

7. The outer shroud for a solid fuel nozzle tip of claim 6, wherein the joiner plate is mounted by at least one of a weld and bolting.

8. The outer shroud for a solid fuel nozzle tip of claim 6, wherein the solid fuel nozzle tip is mounted to at least one of the top shell portion and the bottom shell portion by the at least one joiner plate.

9. The outer shroud as in claim 7, wherein the joiner plate is mounted by a bolt disposed in an annulus of at least one of the left inlet sidewall and the right inlet sidewall.

10. The outer shroud for a solid fuel nozzle tip of claim 1, wherein the single piece of flat stock which forms each of the top shell portion and the bottom shell portion comprises at least one slit adapted for shaping the top shell portion or the bottom shell portion.

11. The outer shroud for a solid fuel nozzle tip of claim 10, wherein the single piece of flat stock which forms each of the top shell portion and the bottom shell portion further comprises:

a right flap adapted for shaping of the right outlet sidewall; and a left flap adapted for shaping of the left outlet sidewall.

12. The outer shroud for a solid fuel nozzle tip of claim 1, wherein the single piece of flat stock which forms each of the top shell portion and the bottom shell portion comprises at least one of a right flap adapted for shaping of the right outlet sidewall and a left flap adapted for shaping of the left outlet sidewall.

13. The outer shroud for a solid fuel nozzle tip of claim 1, wherein the forward area of each of the top shell portion and the bottom shell portion comprises a left slit, disposed proximate to the left outlet sidewall in the forward area, and a right slit, disposed proximate to the right outlet sidewall in the forward area.

* * * * *

UNITED STATES PATENT AND TRADEMARK OFFICE

CERTIFICATE OF CORRECTION

PATENT NO. : 8,267,020 B2
APPLICATION NO. : 11/758253
DATED : September 18, 2012
INVENTOR(S) : Jeffrey S. Mann It is certified that error appears in the above-identified patent and that said Letters Patent is hereby corrected as shown below:

In column 1, line 27, delete “hi” and insert -- In --, therefor.

Signed and Sealed this
Eighth Day of January, 2013

David J. Kappos

David J. Kappos
*Director of the United States Patent and Trademark Office*